United States Patent [19]

Czebiniak

[11] 3,982,258

[45] Sept. 21, 1976

[54] PHOTOGRAPHIC PLATE DEVELOPER APPARATUS

[75] Inventor: Walter N. Czebiniak, Sunnyvale, Calif.

[73] Assignee: GAF Corporation, New York, N.Y.

[22] Filed: July 1, 1974

[21] Appl. No.: 484,951

[52] U.S. Cl. ..... 354/300
[51] Int. Cl.[2] ..... G03D 7/00
[58] Field of Search ..... 354/297, 300

[56] References Cited

UNITED STATES PATENTS

| | | | |
|---|---|---|---|
| 2,694,353 | 11/1954 | Hellsten | 354/300 X |
| 3,811,771 | 5/1974 | Hays | 354/300 X |
| 3,836,987 | 9/1974 | Gibbons et al. | 354/300 |

FOREIGN PATENTS OR APPLICATIONS

| | | | |
|---|---|---|---|
| 573,464 | 4/1959 | Canada | 354/300 |
| 477,896 | 10/1951 | Canada | 354/300 |
| 1,480,476 | 4/1967 | France | 354/300 |
| 1,053,617 | 9/1953 | France | 354/300 |
| 641,204 | 1/1937 | Germany | 354/300 |
| 780,220 | 7/1957 | United Kingdom | 354/300 |

*Primary Examiner*—Fred L. Braun
*Attorney, Agent, or Firm*—Walter C. Kehm; Arthur Dresner

[57] ABSTRACT

An apparatus for developing non-silver halide sensitized photo plates by exposing the plates to wetted ammonia vapor includes within a single compact housing a humidification chamber containing concentrated ammonium hydroxide, a condensation chamber or trap having one common wall with the humidification chamber and apertures therein for communicating with the humidification chamber and a developer chamber having a common wall with the condensation chamber with apertures therein for communicating therebetween. A gas dispersion tube communicates with the humidification chamber for bubbling ammonia gas through the ammonium hydroxide to produce the wetted ammonia vapor. The vapor is conveyed through the condensation chamber where liquid drops are condensed out, and then to the developer chamber where plates may be carried in a rack for exposure to the vapor. The developer chamber has a closable access opening for insertion and removal of the plates.

14 Claims, 5 Drawing Figures

PHOTOGRAPHIC PLATE DEVELOPER APPARATUS

BACKGROUND OF THE INVENTION

The present invention relates generally to the art of development techniques and processing photographic plates. Specifically, the present invention is directed to a novel apparatus for ammonia development of sensitized photographic plates, such plates being used as photographic masks for use in the manufacture of microelectronic components and devices.

Heretofore, microelectronic components and devices have been made by light exposure of a photo-resist coating on a suitable substrate, such as $SiO_2$ — coated Si wafer, under a photographic mask, wherein desired circuit elements or pattern was recorded in an image-bearing layer. The photoresist is developed to remove portions thereof in accordance with the pattern, and the thereby exposed areas of the underlying substrate are treated to modify its characteristics. A series of patterns may be successively reproduced on the substrate, in each case applying a new photo-resist coating, exposing under an appropriate means in register with the preceding exposure, developing the photo-resist, and subjecting the exposed areas of the substrate to the desired treatment.

Conventionally, photographic masks used in the foregoing process are made with silver halide-gelatin sensitized materials — yielding by conventional development, a mask having a silver image in a gelatin layer. The desired micro-pattern is usually produced on the mask from a large size original, made by drafting methods and reduced by optical projection to the desired size (e.g. a square of the order of 0.1 inch on a side). The micro-pattern is usually reproduced repeatedly on the mask on adjacent areas in the form of a grid (i.e. 3–4 cm. square) which is then printed in the photo-resist layer on a substrate surface. After completing development and treatment of the underlying substrate surface for each photo-resist of the series, the substrate is severed along the lines of the grid to yield a series of chips each bearing the desired components or devices for use in a microelectronic product.

Silver halide-gelatin sensitized materials have a number of serious disadvantages in the above described manufacture of microelectronic components and devices.

Exposure to light under a mask of a photo-resist layer on a substrate is ordinarily carried out by contact printing wherein the imaged gelatin layer of the mask is held in pressure contact with the coated substrate. Gelatin is not reliably durable for this purpose, and is often marred in the contacting process by scratching, abrasion, lateral movement of the contacting surfaces and by pressure contact with minute projections on the substrate surface causing so-called "star-cracking" defects and the like. To prolong the useful life of such masks, it is customary to prepare a "primary" mask with a silver image in a gelatin layer of the desired dimensions, which is used for preparation of "working" masks by contact printing on silver halide-gelatin sensitized material. The "primary" mask is not used for contact printing of the photo-resist coated substrate, but instead, the "working" masks are used for this purpose. Should these be injured, they can be readily replaced.

Moreover, silver halide-gelatin materials are inherently limited in degree of resolution, because of the granular nature of the emulsion. Loss of resolution is compounded in preparing the "working" silver halide mask from the primary mask.

In an attempt to overcome the difficulties resulting from lack of durability of the gelatin surface of "working" masks, it has been proposed to substitute masks formed by deposition of a chromium or other metal film on glass, coating with a photo-resist, exposing under a "primary" mask, developing the photo-resist, and etching away the thereby exposed areas of the chromium film. While the resulting maks are relatively durable, they suffer from defects involving lack of edge sharpness and image degradation as a result of light scattering in the photo-resist layer and of undercutting in the etching process. The highly reflecting character of the Cr surface also tends to impair resolution.

In order to overcome the various disadvantages of the gelatin silver-halide surfaced masks and the vapor-deposited chromium or other metal masks, non-silver halide light sensitive material for production of photographic masks and non-silver halide masks prepared therewith, suitable for contact exposure of photo-resist-coated substrates in the production of microelectronic components and devices, was developed.

The non-silver halide type of photographic masks for the production of microelectronic components and devices are prepared by applying to a surface of a flat, rigid, dimensionally stable transparent base—especially a precision-surfaced glass plate—a thin uniform layer of a volatile, preferably organic, solvent solution of a resin adapted to form an adherent transparent film upon evaporation of the solvent, having also dissolved therein a photo-sensitizing composition comprising an azo coupling component and a light-sensitive diazonium compound susceptible to decomposition on exposure to actinic light. The composition is temporarily stabilized against coupling pending development by treatment with an alkaline developer. The photo-sensitizing composition yields a molecular dispersion of its components in the resin upon evaporation of the solvent from the layer. The quantity of solution is limited so as to provide a layer of uniform thickness— e.g. by spraying, roller application or preferably, by applying an excess of the solution and centrifugal removal of the excess by spinning.

A clear glass plate is preferably used as the base to which the sensitizing composition is applied in preparing the non-silver halide photographic mask. These plates may range in size from about 2 ×2 inches to about 4 × 5 inches and from about 0.008 to 0.15 inch thick.

After application of the light-sensitive layer to the surface of the base, and removal of the volatile solvent by evaporation, the sensitized plates are exposed to actinic light—preferably by contact exposure—under a "primary" mask bearing therein the desired pattern (e.g. as a photographic silver image) of a microelectronic component or device to be reproduced on the surface of a suitable microelectronic substrate. The plate is then developed by exposure to ammonia vapor. The latter is preferably moist but may be anhydrous, and may, if desired, be applied at superatmospheric pressure to accelerate development. Excess ammonia can be removed by flushing with air, nitrogen or other inert gas or the like. A full and detailed description of the non-silver halide light-sensitive material, the process for making such materials, and masks prepared therewith suitable for contact exposure of photo-resist coated substrates in the production of microelectronic components and devices may be found in U.S. Pat. No. 3,744,904.

The development of the non-silver halide photo-sensitive materials and photo masks made therewith as described in the aforementioned patent, has resulted in a need for appropriate apparatus with which to expose the sensitized plates to wetted ammonia for development in making the photo masks.

Prior attempts at providing such apparatus have ranged from the use of a simple non-sealed plastic container housing a single plate, and having an opening to receive the wetted (moisturized) ammonia, to larger chambers accommodating as many as 60 plates on a rack, but also merely having a sealed door providing access for insertion and removal of the plates, and an opening for connection to a conduit to supply the moisturized ammonia to the chamber. The use of these simple containers require additional apparatus remote from the chamber for wetting pure ammonia gas to the proper level, a separate trap for removing moisture droplets from the wetted ammonia and connection means to the chamber for supplying wetted ammonia vapor to the chamber housing the plates to be developed.

Such prior developing apparatus have been found to require elaborate set-up arrangements. They have been difficult to use as they entail the assembly of a variety of separate components, containers, chambers and supply and connection conduits.

The use of multiple connections between the various containers or chambers results in the danger of inadequate seals and connections between chambers.

It is accordingly one object of the present invention to provide an apparatus for exposing the sensitized and light-exposed plates to ammonia vapors for developing the masks which avoids the disadvantages of prior apparatus.

A further object of the present invention is to provide a compact utilized structure for evenly and uniformly distributing ammonia vapors of desired moisture content to a plurality of sensitized and light-exposed plates.

A still further object of the present invention is to provide a photo plate development chamber which is capable of accommodating a plurality of plates previously sensitized with a non-silver halide light-sensitive material and exposed to actinic light in order to develop such plates to form a "working" mask for use in production of microelectronic components and devices.

Another object of the present invention is to provide an apparatus for controlling moisturization of ammonia used in the development of photo-resist masks.

A further object is to overcome the disadvantages of the prior devices used to expose the plates to ammonia by providing an apparatus containing in a single housing the various required components to provide the proper level of wetted ammonia.

SUMMARY OF THE INVENTION

The above and other objects are generally accomplished by providing an apparatus for accommodating and exposing a plurality of sensitized plates, previously exposed to actinic light, to moisturized ammonia vapor in order to develop the plates into photographic masks. The apparatus is generally formed by a humidity conditioning chamber containing concentrated ammonium hydroxide through which ammonia gas may be bubbled so as to become moisturized; a trap (condensation) chamber adjacent the humidity conditioning chamber, means connecting the humidity conditioning chamber to the trap chamber; a development chamber adjacent the trap chamber for accommodating the plurality of plates to be developed and exposed to moisturized ammonia, and means connecting the development chamber with the trap chamber for supplying moisturized ammonia thereto. The three chambers are supported in a single housing so as to form a compact structure. A closable opening is provided in the development chamber so as to provide access thereto for insertion and removal of plates to be developed. Conduit means are connected to the development chamber for supplying dry air or nitrogen in order to flush the development chamber clean of residual ammonia after a development process has taken place.

The above objects, features and advantages along with other objects, features and advantages of the present invention will become apparent from the following detailed description of the invention in conjunction with the drawings.

DESCRIPTION OF THE INVENTION

Figure 1:
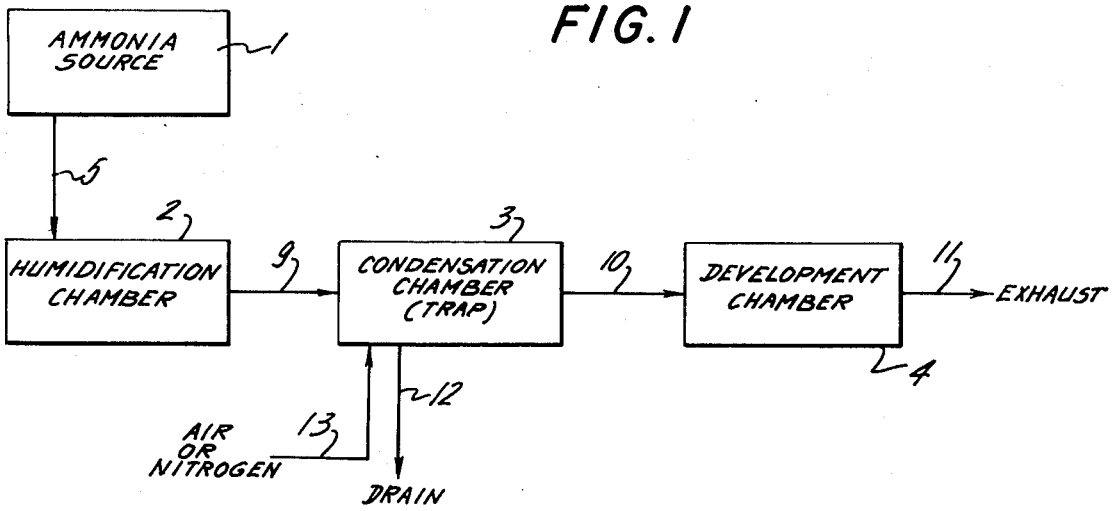
FIG. 1 is a block flow diagram indicating the various elements and chambers of the present invention in relation to ammonia vapor flow for development of the plates.

Referring now in more detail to the drawings which show one embodiment of the present invention and with reference to FIG. 1, an ammonia source 1 is provided to supply ammonia gas through conduit 5 to a humidification chamber 2. The chamber carries a supply of liquid ammonium hydroxide through which the ammonia gas from conduit 5 is bubbled so that the ammonia becomes wetted with the ammonium hydroxide. The wetted ammonia vapor is then passed by a connection 9 to a condensation chamber (or trap) 3 where objectionable droplets of wetted ammonia in the liquid phase is removed through a drain 12. The remaining wetted ammonia in vapor stage is then conducted through connection 10 to the development chamber 4 which houses the plurality of sensitized and light-exposed plates. The vapor is conducted through the development chamber so as to create a concentrated condition of ammonia vapors within the development chamber. This is accomplished by providing exhaust outlet 11 communicating with the developing chamber so that a constant flow of wetted ammonia vapor passes through the chamber. In order to insure a completely concentrated condition within the development chamber the steady flow of ammonia vapor is allowed to continue for a period of 5 to 10 minutes. This will insure complete exposure of each of the plates to the ammonia in order to accomplish complete development of the imaged photographic plates. Prior to exposing the plates to the flow of ammonia vapor within the development chamber the entire system may be flooded with ammonia gas for a period of 2 to 3 minutes.

Under-development of the plates will become obvious from observation thereof and is evidenced by low density in the unexposed areas. This may be easily corrected by continued or longer exposure to the ammonia vapors. The non-silver halide photo-sensitive material which has been coated on the plates cannot be overdeveloped so that longer exposure time will not produce defective plates to be used as masks.

After complete development, chambers 3 and 4 may be flushed with dry air or nitrogen to remove residual ammonia. Residual ammonia vapors will be forced through exhaust 11 so that upon opening of the development chamber to retrieve the developed plates no objectionable ammonia vapor or gas will be present to contaminate the ambient.

FIGS. 2 through 5 show an embodiment of the invention in which chambers 2, 3 and 4 of FIG. 1 are accommodated in a single housing 20 formed as an integral unit with the chambers being bounded at least in part by the walls of the housing. Humidification chamber 2, condensation chamber 3 and development chamber 4 are arranged within the housing in an in-line relationship so that chambers 2 and 3 have a first common boundary and chambers 3 and 4 have a second common boundary.

Figure 2:
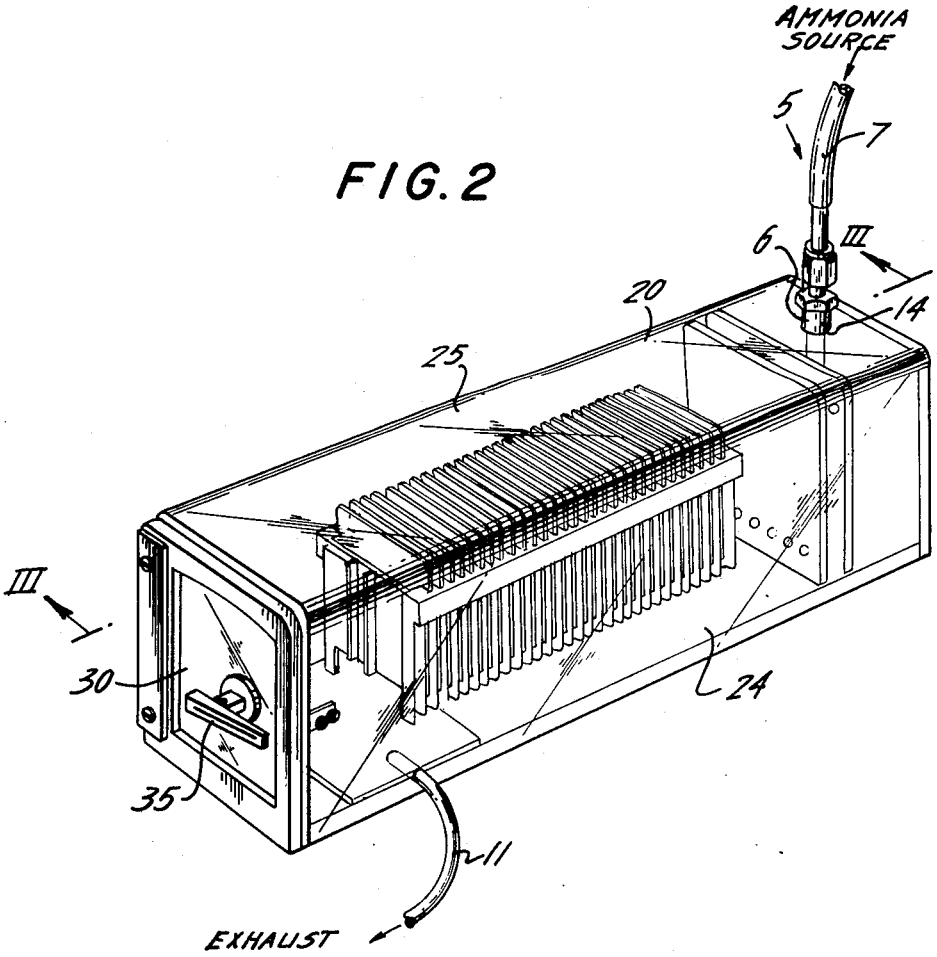
FIG. 2 is a perspective view of the present invention showing the various elements indicated in FIG. 1 contained in a single integral housing.
Figure 3:
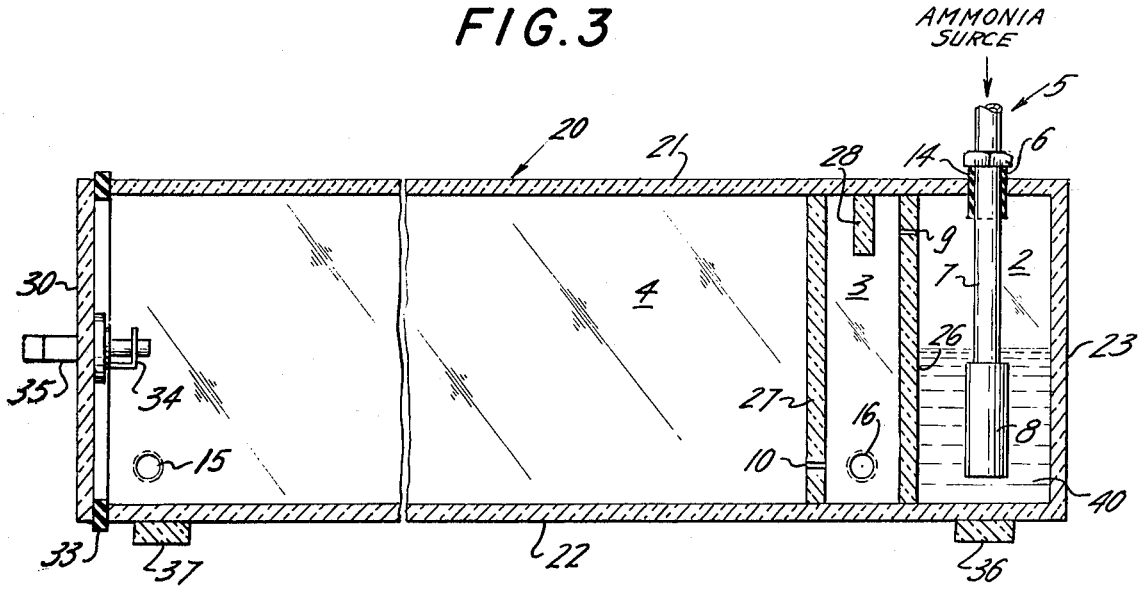
FIG. 3 is a cross-sectional view of the present invention taken along lines III—III of FIG. 2.
Figure 4:
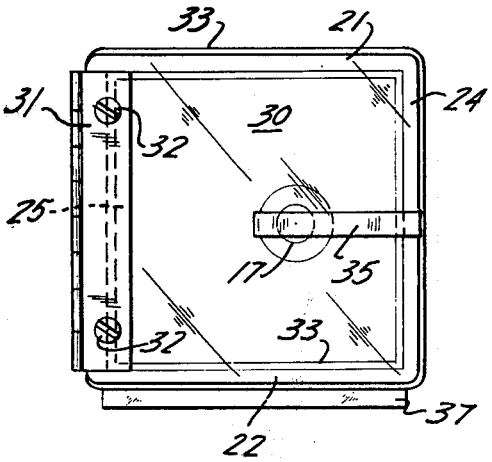
FIG. 4 is a front elevational view of the apparatus shown in FIG. 2 showing one end thereof.

In FIG. 2 a plurality of sensitized plates supported in a rack is shown accommodated within the development chamber 4, however, the rack and plurality of plates form no part of the present invention.

The housing 20 is formed by a top wall 21, a bottom 22, a rear end wall 23, side walls 24 and 25 and a front door (cover) 30 forming a box-like configuration.

The humidification chamber 2 is formed by the inside surfaces of rear wall 23, portions of top wall 21, bottom 22 and side walls 24 and 25, and enclosed by a baffle 26. An aperture 14 is formed in top wall 21, for receiving conduit 5 from the ammonia source. Conduit 5 is formed by the 7 impermeable to ammonia gas and is preferably of clear non-porous polyethylene. A seal 6, preferably of rubber, surrounds tube 7 as it passes through top wall 21 into humidification chamber 2. Depending from tube 7 and in communication, therewith is a gas dispersion tube 8. Such a tube may also be made of polyethylene having a plurality of pores each of which are preferably approximately 40 microns in diameter. Such gas dispersion tubes are commercially available.

Figure 5:
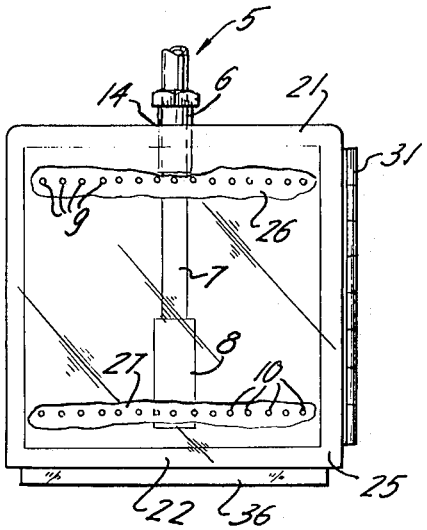
FIG. 5 is a rear elevational view of the invention shown in FIG. 2 showing the other end thereof and partly broken away.

The condensation chamber, (or baffle chamber), is formed between baffles 26 and 27. Each of these baffles may be formed integrally with the top, bottom and side walls of the housing during a molding operation or may be fabricated from sheet stock and secured in position by appropriate adhesives. A depending wall 28 may extend downwardly from top 21 into the condensation chamber 3 to serve as a collecting surface for ammonia or ammonia hydroxide condensate formed in the humidification chamber. A plurality of holes 9 formed in an upper portion of baffle 26 serves as a communication between humidification chamber 2 and condensation chamber (baffle chamber) 3. As seen in FIG. 5 in upper cut-away portion thereof, there are 15 such communication holes formed in baffle 26 each being approximately 1/16 of an inch in diameter and each being spaced approximately ¼ inch from adjacent holes. While this arrangement has been found to be satisfactory any other convenient means for establishing communication between adjacent chambers 2 and 3 will be satisfactory provided the vapors which exit the humidification chamber 2 are not directly communicated to the development chamber 4 since this may result in liquified ammonium hydroxide entering chamber 4.

A series of holes 10 formed in baffle 27 serves for communication between baffle chamber 3 and development chamber 4. As noted in the lower broken-away portion of FIG. 5, 15 such holes are provided along a common center line each being approximately 1/16 of an inch in diameter and spaced approximately ¼ of an inch apart. In the drawings the row of holes 9 is shown as being along a common diametric axis spaced approximately ¾ of an inch from top wall 21, and the common axis of lower holes 10 in the baffle 27 are indicated as being spaced approximately ¾ of an inch from the outside surface of bottom wall 22. It is desired that holes 9 in baffle 26 be aligned along an axis which is remote from the axis along which holes 10 in baffle 27 are located. This will allow any liquified drops of ammonia to be condensed within the baffle chamber so that only wetted ammonia vapor enters development chamber 4 through communication holes 10. It has been found that droplets of ammonia which come into contact with the non-silver halide sensitized surface of the plates may cause damage to the resulting mask and produce a defective product. Hence it is desirable that all liquified droplets of ammonia be removed from the vapor prior to the vapor entering the development chamber.

An aperture 16 may be provided in one of the side walls of baffle chamber 3 for communication with duct 12 leading to a drain or for connection to a duct 13 connected to a source of air or nitrogen for flushing the system after the development process.

Development chamber 4 is formed by portions of top wall 21, bottom 22, side walls 24 and 25, baffle 27 and inside surface of door 30. This chamber may be dimensioned so as to accommodate the various size plates commonly in use.

Door 30 is swingably carried on hinge 31 which is secured thereto by pins or rivets 32. A gasket ring 33, preferably made of sponge rubber, is carried at the front open end of the development chamber so as to form a seal between door 30 when in the closed position and the end of the top, bottom and side walls of the chamber. A latch 34 operated by handle 35 which is mounted for pivotal movement through aperture 17 in the door 30 is provided to insure secure closure of the development chamber. Access to the development chamber so as to insert and remove the plates for development is provided through the front opening of the chamber with door 30 in the opened position.

An aperture 15 is provided in a side wall of the development chamber 4 so as to provide connection means for exhaust conduit 11.

Legs 36 and 37 may be provided to support the housing upon an operating surface.

The developer apparatus, according to the invention, may have any convenient size depending upon the size of the plates to be developed. In practice, it has been found acceptable to provide a housing 20 having an overall length of approximately 15 inches, a width having an outside dimension of 4½ inches, inside dimensions of 4 inches, and a height having an inside dimension of 4 inches and outside dimension of 4½ inches. The top, bottom, rear, and side walls have been integrally formed by a molding operation. Baffles 26 and 27 have similarly been integrally molded with the housing. This eliminates the need for assembly of these parts and possibility of leakage at the joints. Fabrication from sheet stock may, however, be acceptable. The various walls and baffles have been formed of ¼ inch thick plexiglass which provides adequate strength and rigidity to the structure. Humidification chamber 2 has an inside dimension of 1¾ inches in length (i.e. inside surface of baffle 26 is spaced from inside surface of rear wall 23 by 1¾ inches). The width of baffle chamber 3 is 1 inch (i.e. 1 inch between inside surfaces of baffles 26 and 27), while depending wall 28 may have a height of ¾ inch and a thickness of ¼ inch integrally formed during a molding operation with top wall 21.

A development apparatus with the foregoing dimensions has been found to be appropriate for accommodating 30 of the non-silver halide photo mask plates supported in a plate carrier 3½ inches in length. Such a development assembly is suitable for developing plates of the 2 × 2 inches size.

In operation, pure ammonia gas is supplied from the source through tube 8 (conduit 5) into gas dispersion tube 8 where the gas is caused to bubble through concentrated ammonium hydroxide (concentration of approximately 28.5%) to as to become wetted or moisturized before entering the development chamber. The wetted vapor is then communicated through holes 9 into baffle chamber 3 where any liquid droplets of the wetted ammonia will be condensed and removed through drain 16. Wetted ammonia in the vapor phase only is then conveyed to development chamber 4 through holes 10 in baffle 27. A continuous flow of wetted ammonia vapor is caused to flow through the development chamber by continuous feeding of pure ammonia gas from the source into the gas dispersion tube 8 so as to slightly pressurize the vapor. The flow is continued until a concentrated condition exists within the development chamber for a sufficient period of time to cause complete development of the plates. After complete development the source is turned off and the development chamber may be flushed with dry air or nitrogen supplied through opening 16 in baffle chamber 3.

Upon complete development of the plates and flushing of the development chamber, door 30 may be swung about its hinges to an open position providing access to the chamber for removal of any plates.

Additional structure which forms no part of the present invention may be provided within the development chamber for supporting a plurality of plates in any desired position.

The developer, according to the present invention, has been found to produce very desirable results in that it combines a compact unitary structure for the various components of an ammonia development process permitting ease of use and low cost operation.

While the invention has been described and illustrated with respect to a certain preferred embodiment which gives satisfactory results, it will be understood by those skilled in the art, after understanding the purpose of the invention, that various other changes and modifications may be made without departing from the spirit and scope of the invention.

What is claimed is:

1. An apparatus for exposing sensitized photographic plates to a developer, comprising a housing, a first chamber within said housing for moisture conditioning dry developer, a second chamber within said housing for accommodating the sensitized photographic plates, means communicating between said first and second chambers for conveying said moisturized developer from said first chamber to said second chamber, means within said housing for preventing moisturized developer in the liquid state from entering said second chamber, means providing access to said second chamber for entry and removal of said plates, said means for preventing liquid developer from entering said second chamber comprising a trap having first conveying means communicating with said first chamber and second conveying means communicating with said second chamber, said means communicating between said first and second chambers being formed by said first and second conveying means, said trap having a first wall common with said first chamber and a second wall common with said second chamber.

2. Apparatus for exposing photographic plates to alkaline developer comprising, a housing having outer walls, a humidification chamber for wetting dry gas to form vaporized alkaline developer, a development chamber for carrying said photographic plates for exposure to said developer, said development chamber bounded at least in part by a portion of the outer walls of said housing, means providing access to said development chamber for insertion and removal of said plates therefrom, a condensation chamber within said housing for preventing developer in the liquid state from being supplied to said development chamber, said condensation chamber being bounded at least in part by another portion of said outer walls of said housing and located intermediate and humidification chamber and said development chamber, a first baffle defining a common boundary between said humidification chamber and said condensation chamber and providing means communicating between said humidification chamber and said condensation chamber so that wetted alkaline developer is conveyed from said humidification chamber to said condensation chamber, and means communicating between said condensation chamber and said development chamber for supplying wetted alkaline developer thereto.

3. The apparatus according to claim 2 wherein said communication means between said humidification and condensation chambers comprises a plurality of apertures in said first baffle.

4. The apparatus according to claim 2 further comprising a second baffle forming a common boundary between said condensation chamber and said development chamber providing said means communicating between said condensation and development chambers so that vaporized alkaline developer will be conveyed to said development chamber.

5. The apparatus according to claim 4 wherein said communication means between said condensation and development chambers comprises a plurality of apertures in said second baffle.

6. The apparatus according to claim 4 further comprising a condensation wall within said condensation chamber between said first and second baffles for collecting condensate thereon.

7. The apparatus according to claim 2 wherein said access means comprises an opening in said development chamber of sufficient size to pass therethrough a photographic plate, closure means mounted on said housing for closing and sealing said opening.

8. The apparatus according to claim 2 further comprising a concentrated solution of ammonium hydroxide carried in said humidification chamber, supply means connected to said humidification chamber for supplying thereto ammonia gas from a source of ammonia to be wetted by said ammonium hydroxide, and gas dispersion means connected to said supply means at least partially immersed within said ammonium hydroxide so that said ammonia will be bubbled therethrough.

9. The apparatus according to claim 8 wherein said ammonium hydroxide is approximately 28.5% concentrated.

10. The apparatus according to claim 8 wherein said gas dispersion means comprises a porous gas dispersion tube having a pore size of approximately 40 microns.

11. The apparatus according to claim 2 further comprising exhaust means connected to said development chamber for removing said vaporized developer therefrom.

12. The apparatus according to claim 2 further comprising drain means connected to said condensation chamber for removing condensed developer therefrom.

13. The apparatus according to claim 2 further comprising means connected to said housing for supplying dry air or nitrogen thereto for flushing said housing clean of developer vapor.

14. An apparatus for exposing sensitized photographic plates to an ammonia vapor for development comprising:

a. a housing;

b. a humidification chamber within said housing, concentrated ammonium hydroxide contained within said humidification chamber;

c. means connected to said humidification chamber for supplying ammonia gas thereto so that said ammonia gas will bubble through said ammonium hydroxide to produce wetted ammonia vapor;

d. a condensation chamber within said housing for condensing and removing liquid drops of wetted ammonia, said condensation chamber having a first wall forming a common boundary with said humidification chamber, and aperture means in said first wall communicating between said humidification and condensation chambers;

e. a development chamber within said housing for accommodating and exposing said photographic plates to said wetted ammonia, said condensation chamber having a second wall forming a common boundary with said development chamber, and aperture means in said second wall communicating between said condensation and development chambers so that wetted ammonia in the vapor phase will be conveyed to said development chamber;

f. the aperture means in said first and second walls being aligned on different axes; and g. closable access means to said development chamber for insertion and removal of said plates.

* * * * *

Disclaimer 3,982,258.—*Walter N. Czebiniak*, Sunnyvale, Calif. PHOTOGRAPHIC PLATE DEVELOPER APPARATUS. Patent dated Sept. 21, 1976. Disclaimer filed Sept. 30, 1982, by the assignee, *Eastman Kodak Co.*

Hereby enters this disclaimer to all claims of said patent.

[*Official Gazette March 22, 1983.*]